US010517350B2

(12) United States Patent
Orand et al.

(10) Patent No.: US 10,517,350 B2
(45) Date of Patent: Dec. 31, 2019

(54) SOLE STRUCTURE FOR AN ARTICLE OF FOOTWEAR HAVING LONGITUDINAL EXTENDING BRIDGE PORTIONS WITH AN INTERWOVEN STIFFNESS CONTROLLING DEVICE

(71) Applicant: NIKE, Inc., Beaverton, OR (US)

(72) Inventors: Austin Orand, Portland, OR (US); Aaron Weast, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 72 days.

(21) Appl. No.: 15/615,111

(22) Filed: Jun. 6, 2017

(65) Prior Publication Data

US 2017/0354200 A1 Dec. 14, 2017

Related U.S. Application Data

(60) Provisional application No. 62/349,897, filed on Jun. 14, 2016.

(51) Int. Cl.

| | |
|---|---|
| ***A43B 13/14*** | (2006.01) |
| ***A43B 13/12*** | (2006.01) |
| ***A43B 13/22*** | (2006.01) |

(52) U.S. Cl.

CPC ..... *A43B 13/141* (2013.01); *A43B 13/122* (2013.01); *A43B 13/223* (2013.01)

(58) Field of Classification Search

CPC ... A43B 13/141; A43B 13/203; A43B 13/181; A43B 13/122; A43B 13/223; A43B 13/125; A43B 5/02; A43B 13/143; A43B 17/02; A43B 13/00; A43B 13/10; A43B 13/12; A43B 13/026; A43B 13/185; A43B 13/186; A43B 17/006; A43B 3/26

USPC ..... 36/25 R, 103, 28

See application file for complete search history.

(56) References Cited

U.S. PATENT DOCUMENTS

| | | | |
|---|---|---|---|
| 634,588 | A | 10/1899 | Roche |
| 1,964,406 | A | 6/1934 | Pellkofer |
| 2,072,785 | A | 3/1937 | Wulff |
| 2,342,188 | A | 2/1944 | Ghetz et al. |

(Continued)

FOREIGN PATENT DOCUMENTS

| | | | |
|---|---|---|---|
| DE | 315919 | C | 11/1919 |
| DE | 202007000831 | U1 | 5/2007 |

(Continued)

*Primary Examiner* — Katharine Gracz
*Assistant Examiner* — Aiying Zhao
(74) *Attorney, Agent, or Firm* — Quinn IP Law

(57) ABSTRACT

A sole plate includes slots spaced apart from each other and extending along a longitudinal axis to define at least one interior bridge portion disposed therebetween. A lateral bridge portion is disposed between a lateral side of the sole plate and a lateral most one of the slots, and a medial bridge portion is disposed between a medial side of the sole plate and a medial most one of the slots. A stiffness controlling device is interlaced between the lateral bridge portion, the interior bridge portions, and the medial bridge portion, and is moveable within the slots, between a first position and a second position, for changing between a first bending stiffness at a specific flex angle when the stiffness controlling device is in the first position, and a second bending stiffness at the specific flex angle when the stiffness controlling device is in the second position.

24 Claims, 8 Drawing Sheets

(56) References Cited

U.S. PATENT DOCUMENTS

| | | | | |
|---|---|---|---|---|
| 2,342,466 | A | 2/1944 | Gordon | |
| 2,364,134 | A * | 12/1944 | Dow | A43B 13/04 36/25 A |
| 2,379,139 | A | 6/1945 | Flink | |
| 2,413,545 | A | 12/1946 | Cordi | |
| 2,470,200 | A | 5/1949 | Wallach | |
| 2,478,664 | A | 8/1949 | Morrow et al. | |
| 2,537,123 | A | 1/1951 | Dowling, Sr. | |
| 2,640,283 | A | 6/1953 | McCord | |
| 2,922,235 | A | 1/1960 | Meltzer | |
| 3,039,207 | A | 6/1962 | Lincors | |
| 3,782,011 | A | 1/1974 | Fisher | |
| 4,026,045 | A | 5/1977 | Druss | |
| 4,255,877 | A | 3/1981 | Bowerman | |
| 4,391,048 | A | 7/1983 | Lutz | |
| 4,476,638 | A | 10/1984 | Quacquarini et al. | |
| 4,573,457 | A | 3/1986 | Parks | |
| 4,779,361 | A | 10/1988 | Kinsaul | |
| 4,839,972 | A | 6/1989 | Pack et al. | |
| 4,920,665 | A | 5/1990 | Pack et al. | |
| 4,936,028 | A | 6/1990 | Posacki | |
| 4,941,273 | A | 7/1990 | Gross | |
| 5,243,776 | A | 9/1993 | Zelinko | |
| 5,392,537 | A | 2/1995 | Goldberg | |
| 5,461,800 | A | 10/1995 | Luthi et al. | |
| 5,572,806 | A | 11/1996 | Osawa | |
| 5,729,912 | A | 3/1998 | Gutkowski et al. | |
| 6,032,387 | A * | 3/2000 | Johnson | A43C 1/06 36/118.1 |
| 6,092,309 | A | 7/2000 | Edwards | |
| 6,125,556 | A | 10/2000 | Peckler et al. | |
| 6,202,326 | B1 | 3/2001 | Hauglin | |
| 6,237,255 | B1 | 5/2001 | Renaudin et al. | |
| 6,338,206 | B1 * | 1/2002 | Kita | A43B 7/082 36/29 |
| 6,769,202 | B1 * | 8/2004 | Luthi | A43B 13/184 36/28 |
| 7,100,308 | B2 | 9/2006 | Aveni | |
| 7,143,530 | B2 | 12/2006 | Hudson et al. | |
| 7,401,422 | B1 | 7/2008 | Scholz et al. | |
| 7,513,065 | B2 | 4/2009 | Kita et al. | |
| 8,037,621 | B2 * | 10/2011 | Hooper | A43B 7/06 36/102 |
| 8,117,770 | B2 | 2/2012 | Wong | |
| 8,151,489 | B2 * | 4/2012 | Marvin | A43B 13/20 36/29 |
| 8,365,444 | B2 | 2/2013 | Youngs | |
| 8,578,629 | B2 | 11/2013 | Bosomworth et al. | |
| 8,646,191 | B2 | 2/2014 | Amos et al. | |
| 9,179,733 | B2 | 11/2015 | Peyton et al. | |
| 10,226,097 | B2 | 3/2019 | Farris et al. | |
| 2001/0007177 | A1 | 7/2001 | Brown, Jr. et al. | |
| 2004/0091675 | A1 * | 5/2004 | Yang | A43B 13/181 428/174 |
| 2005/0000115 | A1 | 1/2005 | Kimura et al. | |
| 2005/0039350 | A1 | 2/2005 | Hung | |
| 2006/0117600 | A1 | 6/2006 | Greene | |
| 2006/0254087 | A1 | 11/2006 | Fechter | |
| 2007/0039208 | A1 | 2/2007 | Bove | |
| 2007/0266598 | A1 * | 11/2007 | Pawlus | A43B 13/141 36/102 |
| 2008/0066348 | A1 | 3/2008 | O'Brien et al. | |
| 2008/0263900 | A1 | 10/2008 | Determe et al. | |
| 2010/0139122 | A1 | 6/2010 | Zanatta | |
| 2010/0218397 | A1 | 9/2010 | Nishiwaki et al. | |
| 2011/0047816 | A1 | 3/2011 | Nurse | |
| 2011/0067264 | A1 * | 3/2011 | Doyle | A43B 13/203 36/29 |
| 2011/0214313 | A1 | 9/2011 | James et al. | |
| 2012/0036739 | A1 | 2/2012 | Amos et al. | |
| 2012/0055047 | A1 | 3/2012 | Youngs | |
| 2013/0139410 | A1 * | 6/2013 | Dirsa | A43B 13/28 36/103 |
| 2013/0326911 | A1 | 12/2013 | Baucom et al. | |
| 2014/0182167 | A1 | 7/2014 | James et al. | |
| 2014/0223778 | A1 | 8/2014 | Horacek | |
| 2014/0250723 | A1 | 9/2014 | Kohatsu | |
| 2014/0259747 | A1 * | 9/2014 | Baudouin | A43B 13/181 36/29 |
| 2014/0366401 | A1 | 12/2014 | Cavaliere et al. | |
| 2015/0027005 | A1 | 1/2015 | Lee et al. | |
| 2015/0047222 | A1 | 2/2015 | Rushbrook | |
| 2015/0089841 | A1 | 4/2015 | Smaldone et al. | |
| 2015/0272267 | A1 * | 10/2015 | Wollo | A43B 5/0413 36/25 R |
| 2015/0282557 | A1 | 10/2015 | Kirk et al. | |
| 2017/0079374 | A1 | 3/2017 | Farris et al. | |
| 2017/0079375 | A1 | 3/2017 | Bunnell et al. | |
| 2017/0079376 | A1 | 3/2017 | Bunnell et al. | |
| 2017/0079378 | A1 | 3/2017 | Farris et al. | |
| 2017/0127755 | A1 | 5/2017 | Bunnell et al. | |
| 2017/0340055 | A1 | 11/2017 | Schneider | |
| 2017/0340056 | A1 | 11/2017 | Bunnell et al. | |
| 2017/0367439 | A1 | 12/2017 | Fallon | |
| 2018/0027922 | A1 | 2/2018 | Orand | |
| 2018/0042338 | A1 | 2/2018 | Orand | |

FOREIGN PATENT DOCUMENTS

| | | | |
|---|---|---|---|
| DE | 102012104264 | A1 | 11/2013 |
| EP | 1127504 | A2 | 8/2001 |
| EP | 1483981 | A1 | 12/2004 |
| EP | 2926678 | A2 | 10/2015 |
| FR | 892219 | A | 3/1944 |
| FR | 2974482 | A1 | 2/2012 |
| WO | 03075698 | A1 | 9/2003 |
| WO | 2006087737 | A1 | 8/2006 |
| WO | 2011005728 | A1 | 1/2011 |

* cited by examiner

SOLE STRUCTURE FOR AN ARTICLE OF FOOTWEAR HAVING LONGITUDINAL EXTENDING BRIDGE PORTIONS WITH AN INTERWOVEN STIFFNESS CONTROLLING DEVICE

CROSS-REFERENCE TO RELATED APPLICATION

This application claims the benefit of priority to U.S. Provisional Application No. 62/349,897 filed on Jun. 14, 2016, which is hereby incorporated by reference in its entirety.

TECHNICAL FIELD

The present disclosure generally relates to a sole structure for an article of footwear.

BACKGROUND

Footwear typically includes a sole structure configured to be located under a wearer's foot to space the foot away from the ground. Sole structures in athletic footwear are typically configured to provide cushioning, motion control, and/or resiliency.

DETAILED DESCRIPTION

Figure 1:
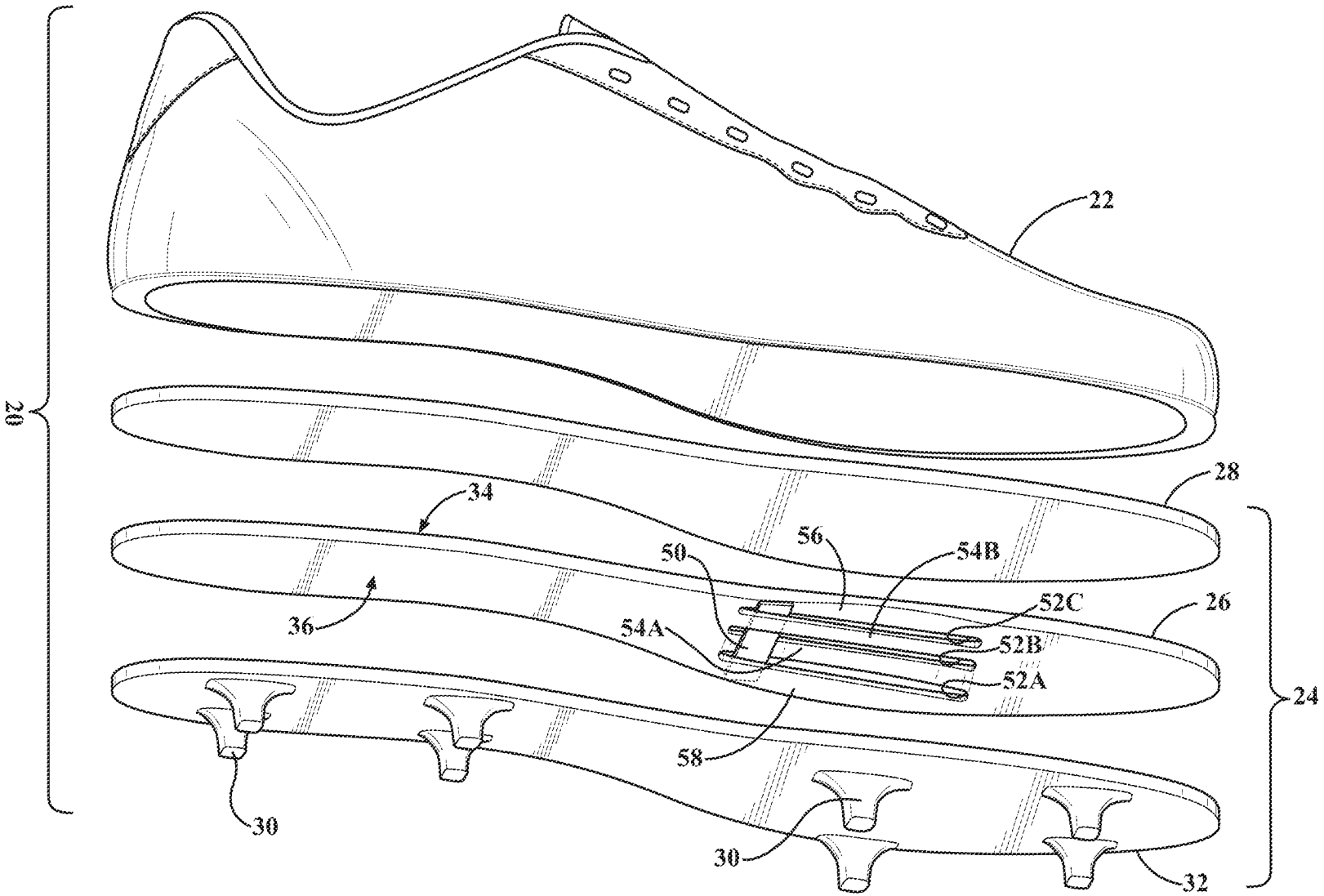
FIG. 1 is a schematic exploded perspective view of an article of footwear having an upper and a sole structure.

A sole structure for an article of footwear includes a sole plate. The sole plate extends along a longitudinal axis, and includes a lateral side and a medial side. The sole plate includes at least two slots extending along the longitudinal axis. The at least two slots define a lateral bridge portion disposed between the lateral side of the sole plate and a lateral most one of the at least two slots, a medial bridge portion disposed between the medial side of the sole plate and a medial most one of the at least two slots, and an interior bridge portion disposed between the at least two slots. A stiffness controlling device extends transverse relative to the longitudinal axis, and is interlaced with the lateral bridge portion, the interior bridge portion, and the medial bridge portion.

In one embodiment, the stiffness controlling device is moveable relative to the sole plate and along the longitudinal axis, within the at least one slot. The stiffness controlling device is moveable between at least a first position and a second position. When the stiffness controlling device is disposed in the first position, the stiffness controlling device is positioned adjacent an axial end of the at least two slots relative to the longitudinal axis. The first position of the stiffness controlling device provides a first bending stiffness of the sole plate, at a specific flex angle, against flexion along the longitudinal axis. When the stiffness controlling device is disposed in the second position, the stiffness controlling device is positioned at an approximate midsection of the at least two slots relative to the longitudinal axis. The second position of the stiffness controlling device provides a second bending stiffness of the sole plate, at a specific flex angle, against flexion along the longitudinal axis. The first bending stiffness of the sole plate at the specific flex angle, with the stiffness controlling device in the first position, is less than the second bending stiffness of the sole plate at the specific flex angle, with the stiffness controlling device in the second position.

In another embodiment, the stiffness controlling device includes an inflatable structure that is moveable, i.e., inflatable, relative to the sole plate, between a non-inflated position to provide provides the first bending stiffness of the sole plate, at the specific flex angle, against flexion along the longitudinal axis, and an inflated position to provide the second bending stiffness of the sole plate, at the specific flex angle, against flexion along the longitudinal axis.

The at least two slots are spaced apart from each other and extend along the longitudinal axis to define the at least one interior bridge portion disposed between the at least two slots.

The sole plate includes a forefoot portion, a midfoot portion, and a heel portion, and presents a foot-receiving surface and a ground-facing surface disposed opposite the foot-receiving surface. In an exemplary embodiment, one or more of the at least one interior bridge portion, the lateral bridge portion, and the medial bridge portion includes a concave shape along the longitudinal axis and relative to the foot receiving surface of the sole plate. One or more of the at least one interior bridge portion, the lateral bridge portion, and the medial bridge portion includes a convex shape along the longitudinal axis and relative to the foot receiving surface of the sole plate.

The sole plate includes a sole thickness between the foot-receiving surface and the ground-facing surface. In an exemplary embodiment, the concave shape and the convex shape of each of the at least one interior bridge portion, the medial bridge portion, and the lateral bridge portion includes a minimum bridge thickness at a midsection thereof that is less than the sole thickness. In some embodiments, the minimum bridge thickness is less than one half the sole thickness.

In an exemplary embodiment, the at least two slots include three slots, and the at least one interior bridge portion includes a first interior bridge portion and a second interior bridge portion. One of the first interior bridge portion and the second interior bridge portion includes a concave shape along the longitudinal axis and relative to the foot receiving surface of the sole plate, and the other of the first interior bridge portion and the second interior bridge portion includes a convex shape along the longitudinal axis and relative to the foot receiving surface of the sole plate. One of the lateral bridge portion and the medial bridge portion includes a concave shape along the longitudinal axis and relative to the foot receiving surface of the sole plate, and the other of the lateral bridge portion and the medial bridge portion includes a convex shape along the longitudinal axis and relative to the foot receiving surface of the sole plate.

In some embodiments, the at least one interior bridge portion, the lateral bridge portion, and the medial bridge portion extend between and connect the forefoot portion and the midfoot portion of the sole plate.

In some embodiments, the stiffness controlling device is a substantially semi-rigid material. In one exemplary embodiment, the stiffness controlling device is a plastic such as nylon. In other embodiments, the stiffness controlling device may include but is not limited to or semi-rigid thermoplastic polyurethane, or a metal such as but not limited to stainless steel or aluminum.

In some embodiments, the stiffness controlling device includes a width measured along the longitudinal axis of the sole plate, which is greater than 3 mm.

The features and advantages of the present teachings are readily apparent from the following detailed description of modes for carrying out the teachings when taken in connection with the accompanying Figures.

The terms "A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps. It should be realized that such block components may be comprised of any number of hardware, software, and/or firmware components configured to perform the specified functions.

Referring to the Figures, wherein like numerals indicate like parts throughout the several views, an article of footwear is generally shown at 20 in FIG. 1. Referring to FIG. 1, the article of footwear 20 includes an upper 22 and a sole structure 24. The sole structure 24 may also be referred to as a sole assembly, especially when a corresponding sole plate 26 is assembled with other sole components in the sole structure 24, such as with other sole layers.

The upper 22 may include, for example, any conventional upper 22 suitable to support, receive and retain a foot of a wearer. The upper 22 includes a void configured to accommodate insertion of the wearer's foot, and to effectively secure the foot within the footwear 20 relative to an upper 22 surface of the sole structure 24, or to otherwise unite the foot and the footwear 20. The upper 22 typically includes one or more components suitable to further secure the user's foot proximate the sole structure 24, such as but not limited to a lace, a plurality of lace-receiving elements, and a tongue, as will be recognized by those skilled in the art. The upper 22 may be formed of one or more layers, including for example, one or more of a weather-resistant layer, a wear-resistant outer layer, a cushioning layer, and/or a lining layer. Although the above described configuration for the upper 22 provides an example of an upper 22 that may be used in connection with the embodiments of the sole structure 24 described herein, a variety of other conventional or nonconventional configurations for the upper 22 may also be utilized.

The sole structure 24 includes the sole plate 26 described herein, and has a nonlinear bending stiffness that increases with increasing flexion of a forefoot portion 38 of the sole plate 26 in a longitudinal direction of the sole plate 26. As further described herein, the sole structure 24, and more specifically the sole plate 26, has at least one stiffness enhancing or altering feature. The stiffness enhancing feature provides an adjustable bending stiffness of the sole structure 24.

The sole structure 24 of the article of footwear 20 extends between the foot and the ground to, for example, attenuate ground reaction forces to cushion the foot, provide traction, enhance stability, and influence the motion of the foot. When the sole structure 24 is coupled to the upper 22, the sole structure 24 and the upper 22 can flex in cooperation with each other.

The sole structure 24 may be a unitary structure with a single layer, or the sole structure 24 may include multiple layers. For example and as shown in FIG. 1, a non-limiting exemplary multiple layer sole structure 24 may include three layers, referred to as an insole 28, the sole plate 26, and an outsole 32 for descriptive convenience herein. The insole 28 may include a thin, comfort-enhancing member located adjacent to the foot. The outsole 32 may include one or more ground engaging elements 30, and is usually fashioned form a durable, wear resistant material. The ground engaging elements 30 of the outsole 32 may include texturing or other traction features or elements, such as cleats, configured to improve traction with one or more types of ground surfaces (e.g., natural grass, artificial turn, asphalt pavement, dirt, etc.). Examples of such wear resistant materials may include, but are not limited to, nylon, thermoplastic polyurethane, carbon fiber, and others, as would be recognized by a person skilled in the art.

In the exemplary embodiment shown in the Figures, the sole plate 26 is an inner sole plate 26 of the sole structure 24. The inner sole plate 26 may also be referred to as an insole plate, an inner board plate, an inner board, or an insole board. In other embodiments, the sole plate 26 may be a midsole plate or a uni sole plate. Optionally, a lining layer, or other sole layers of the article of footwear 20 may overlay a foot-receiving surface 34 of the sole plate 26 and be positioned between the foot and the foot-receiving surface 34. Other sole layers may underlay a ground-facing surface 36 of the sole plate 26, and be positioned between the sole plate 26 and the outsole 32.

Figure 2:
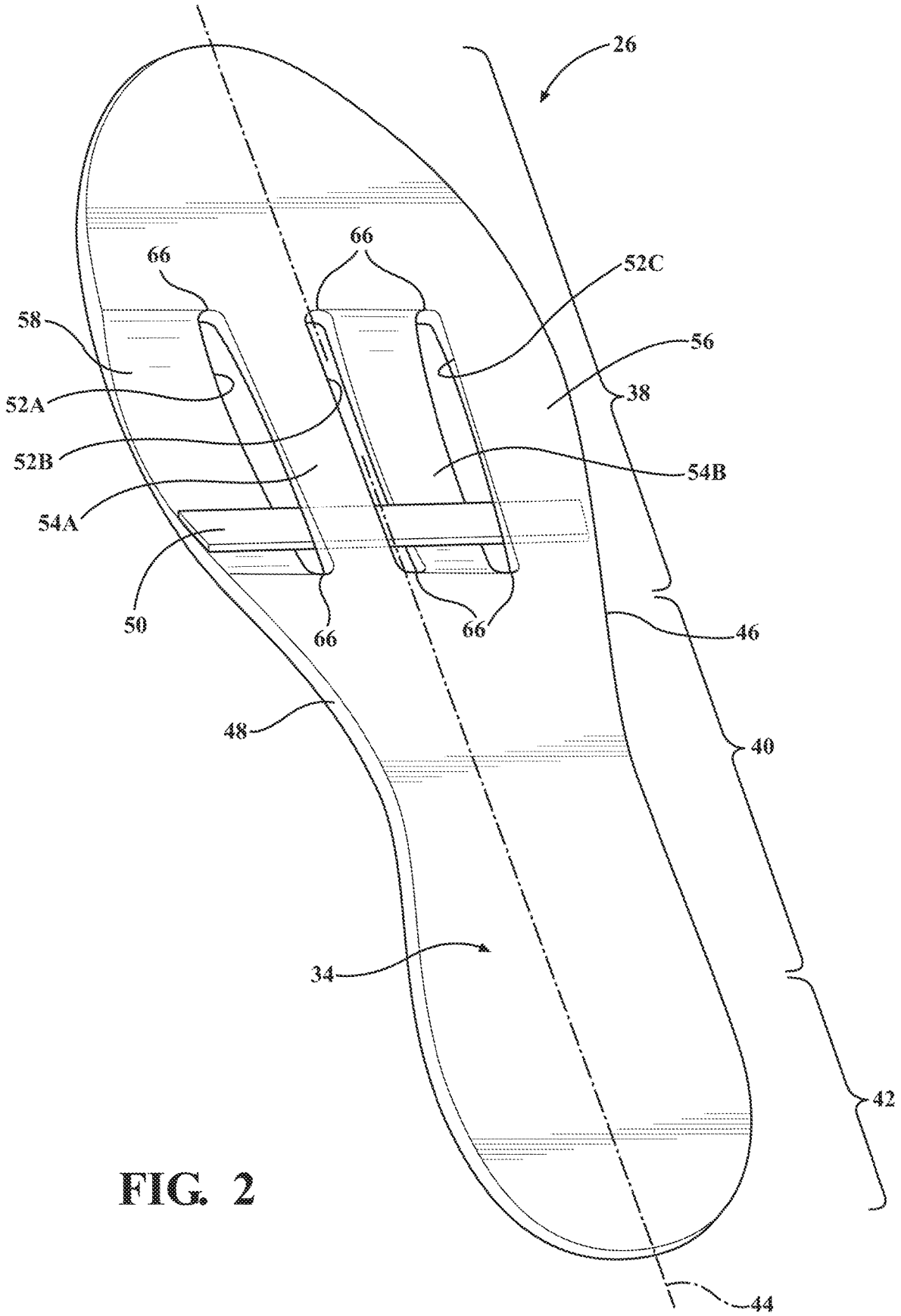
FIG. 2 is a schematic perspective view of a sole plate of the sole structure viewed from a foot-receiving surface of the sole plate, showing a stiffness controlling device in a first position.
Figure 3:
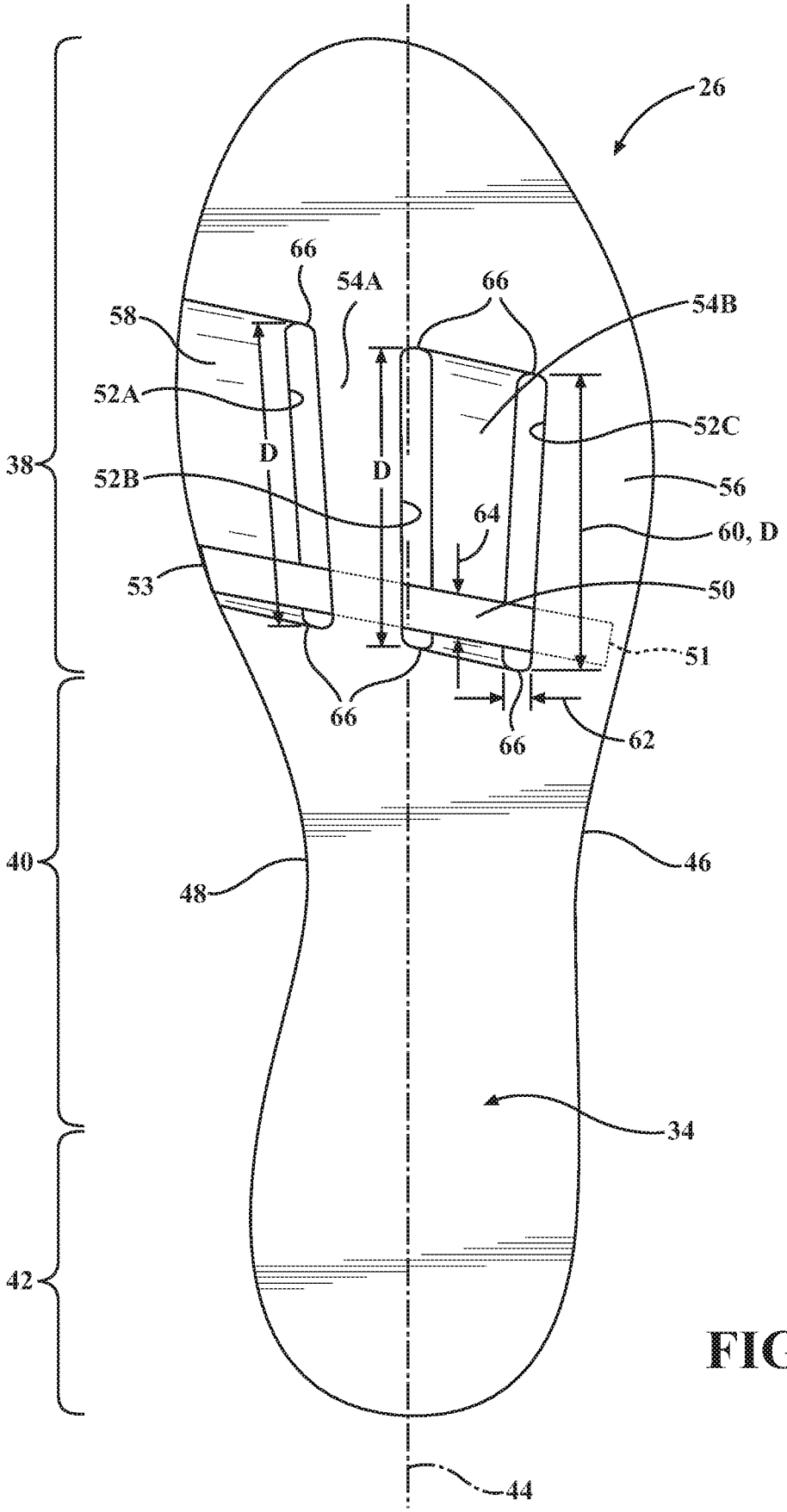
FIG. 3 is a schematic plan view of the sole plate viewed from the foot-receiving surface of the sole plate, with the stiffness controlling device in the first position.
Figure 4:
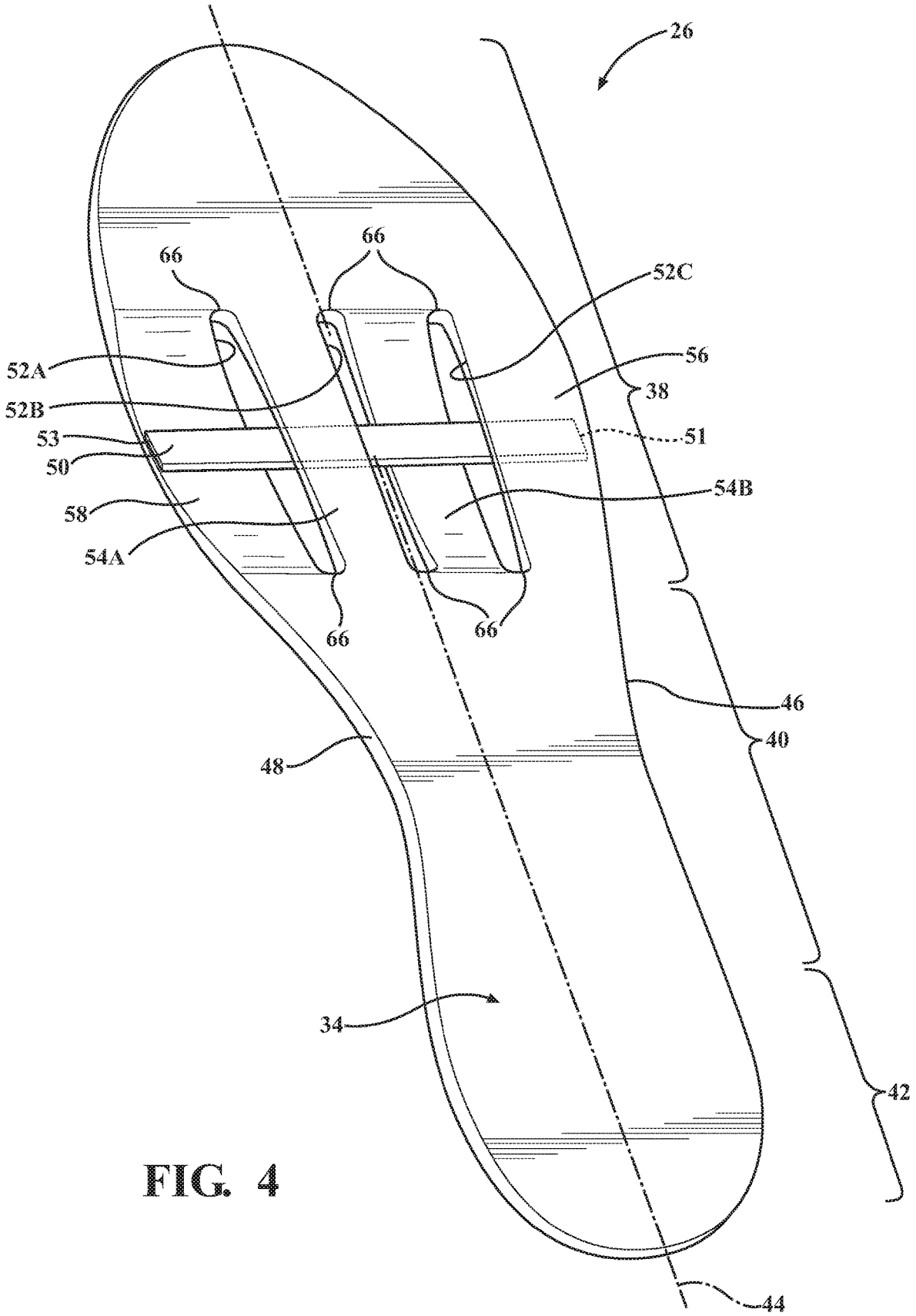
FIG. 4 is a schematic perspective view of the sole plate viewed from the foot-receiving surface of the sole plate, showing the stiffness controlling device in a second position.
Figure 5:
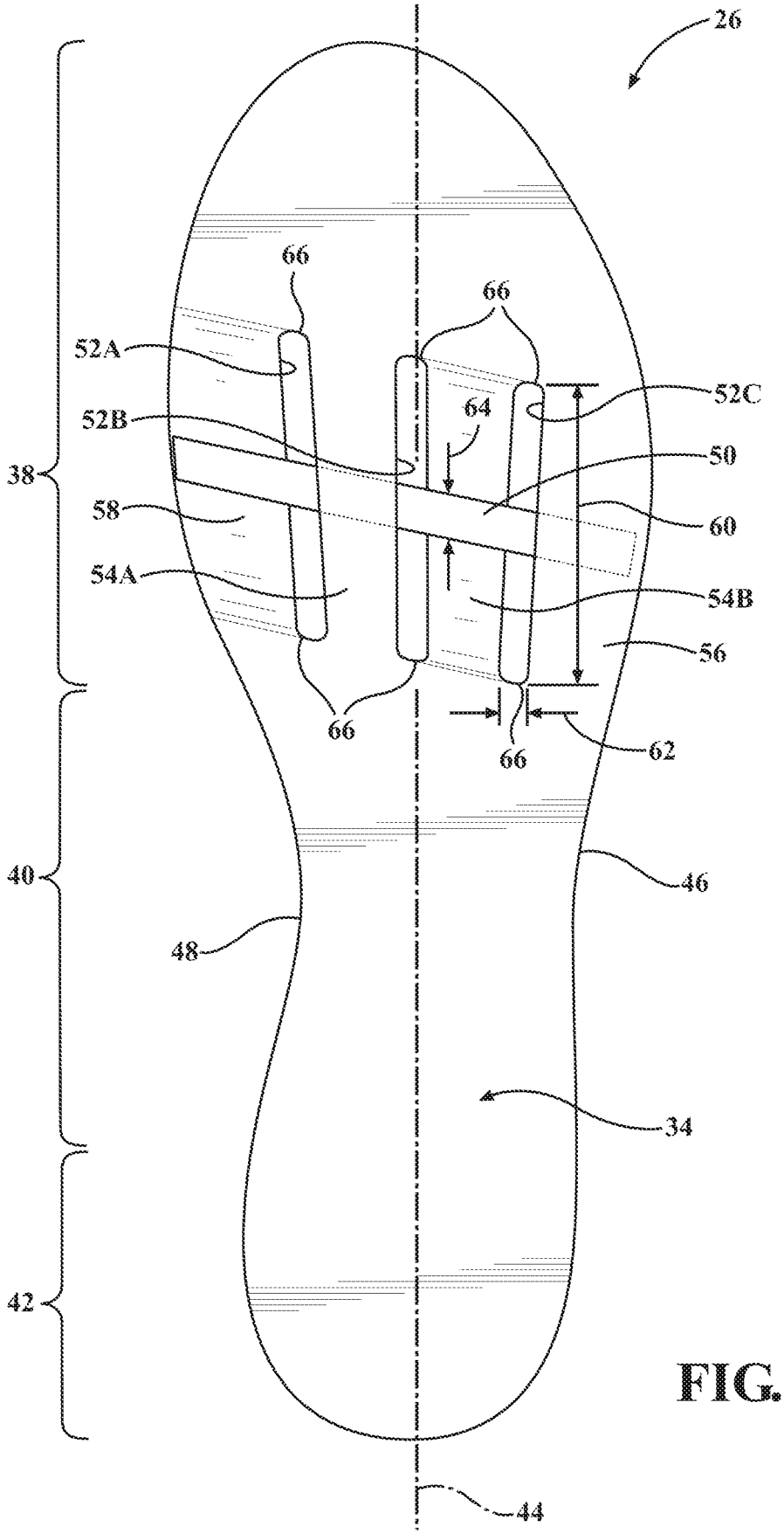
FIG. 5 is a schematic plan view of the sole plate viewed from the foot-receiving surface of the sole plate, with the stiffness controlling device in the second position.

Referring to FIGS. 2-5, the sole plate 26 may be a full-length, unitary sole plate 26 that has a forefoot portion 38, a midfoot portion 40, and a heel portion 42. Alternatively, the sole plate 26 may include a partial length sole plate 26 that includes only the forefoot portion 38 and the midfoot portion 40, and/or portions thereof, and which is attached to other components of the sole structure 24. The heel portion 42 generally includes portions of the sole plate 26 corresponding with rear portions of a human foot, including the calcaneus bone, when the human foot is supported on the sole structure 24 and is a size corresponding with the sole structure 24. The forefoot portion 38 generally includes portions of the sole plate 26 corresponding with the toes and the joints connecting the metatarsals with the phalanges of the human foot. The midfoot portion 40 generally includes portions of the sole plate 26 corresponding with an arch area of the human foot, including the navicular joint. As best shown in FIGS. 3 and 5, the sole plate 26 includes a longitudinal axis 44, which extends along a longitudinal midline of the sole structure 24, between the heel portion 42 and the forefoot portion 38 of the sole structure 24.

As used herein and as best shown in FIGS. 3 and 5, a lateral side of a component for the article of footwear 20, including a lateral edge 46 of the sole plate 26, is a side that corresponds with an outside area of the human foot (i.e., the side closer to the fifth toe of the wearer). The fifth toe is commonly referred to as the little toe. A medial side of a component for an article of footwear 20, including a medial edge 48 of the sole plate 26, is the side that corresponds with an inside area of the human foot (i.e., the side closer to the hallux of the foot of the wearer). The hallux is commonly referred to as the big toe.

The term "longitudinal," as used herein, refers to a direction extending along a length 60 of the sole structure 24, i.e., extending from the forefoot portion 38 to the heel portion 42 of the sole structure 24. The term "transverse" as used herein, refers to a direction extending along a width of the sole structure 24, i.e., extending from the medial edge 48 of the sole plate 26 to the lateral edge 46 of the sole plate 26. The term "forward" is used to refer to the general direction moving from the heel portion 42 toward the forefoot portion 38, and the term "rearward" is used to refer to the opposite direction, i.e., the direction moving from the forefoot portion 38 toward the heel portion 42. The term "anterior" is used to refer to a front or forward component or portion of a component. The term "posterior" is used to refer to a rear or rearward component of portion of a component. The term "plate" such as the sole plate 26, refers to a generally horizontally-disposed member that is generally used to provide support structure and may or may not be used to provide cushioning. As used in this description and the accompanying claims, the phrase "bend stiffness" or "bending stiffness" generally means a resistance to flexion of the sole structure 24 exhibited by a material's composition, structure, assembly of two or more components or a combination thereof, according to the disclosed embodiments and their equivalents.

As noted above and with reference to FIG. 1, the sole plate 26 includes the foot-receiving surface 34 and the ground-facing surface 36. The foot-receiving surface 34 and the ground-facing surface 36 are disposed opposite of each other. A foot may be supported by the foot-receiving surface 34, with the foot disposed above the foot-receiving surface 34. The foot-receiving surface 34 may be referred to as an upper 22 surface of the sole plate 26. The ground-facing surface 36 may be referred to as a lower surface of the sole plate 26.

Various materials may be used to manufacture the sole plate 26 discussed herein. For example, a thermoplastic elastomer, such as thermoplastic polyurethane (TPU), a glass composite, a nylon including glass-filled nylons, a spring steel, carbon fiber, ceramic or a foam or rubber material (such as but not limited to a foam or rubber with a Shore A Durometer hardness of about 50-70 (using ASTM D2240-05(2010) standard test method) or an Asker C hardness of 65-85 (using hardness test JIS K6767 (1976) may be used for the sole plate 26.

The sole plate 26 is referred to as a plate, but is not necessarily flat and need not be a single component but instead can be multiple interconnected components. For example, both the foot-receiving surface 34 and the opposite ground-facing surface 36 may be pre-formed with some amount of curvature and variations in thickness when molded or otherwise formed in order to provide a shaped footbed and/or increased thickness for reinforcement in desired areas. For example, the sole plate 26 could have a curved or contoured geometry that may be similar to the lower contours of a foot. For example, the sole plate 26 may have a contoured periphery that slopes upward toward any overlaying layers, such as a component or the upper 22.

The sole plate 26 may be entirely of a single, uniform material, or may have different portions comprising different materials. For example, a first material of the forefoot portion 38 can be selected to achieve, in conjunction with other features and components of the sole structure 24 discussed herein, the desired bending stiffness in the forefoot portion 38, while a second material of the midfoot portion 40 and the heel portion 42 can be a different material that has little effect on the bending stiffness of the forefoot portion 38. By way of non-limiting example, the second portion can be over-molded onto or co-injection molded with the first portion. Example materials for the sole plate 26 include durable, wear resistant materials such as but not limited to nylon, thermoplastic polyurethane, or carbon fiber.

As noted above, the sole plate 26 includes a stiffness enhancing or altering feature that changes or alters the bending stiffness of the sole plate 26 in the longitudinal direction of the sole plate 26 along the longitudinal axis 44 of the sole plate 26.

In general terms, referring to FIGS. 1-7 the stiffness enhancing feature includes a stiffness controlling device 50 that is interlaced or woven between longitudinally extending bridge portions of the sole plate 26. As shown in the embodiment of FIGS. 1-7, the stiffness controlling device 50 may be referred to as a strap, a plate, a bar, or some other generally elongated, and typically but not exclusively planar, structural member. Accordingly, the stiffness controlling device 50 may alternatively be referred to more specifically as a strap, a plate, a bar, a binding, etc. The stiffness controlling device 50 is moveable, or repositionable, along the longitudinal axis 44 of the sole plate 26 to alter or change the bending stiffness characteristics of the sole plate 26.

The sole plate 26 includes at least one slot 52 that extends along the longitudinal axis 44 of the sole plate 26. In some embodiments, the sole plate 26 includes at least two slots 52. The at least one slot 52 is generally referred to within the written description as the slot 52, and shown in the Figures as a first slot 52A, a second slot 52B, and a third slot 52C. The exemplary embodiment shown in the Figures includes three slots 52A, 52B, and 52C. However, it should be appreciated that the number of slots 52 may vary from a minimum of one slot to any maximum number, including but not limited to two slots, three slots, four slots, five slots, six slots, etc. If configured with two or more slots 52, the at least two slots are spaced from each other to define at least one interior bridge portion 54 disposed between the at least two slots 52. The at least one interior bridge portion 54 is generally referred to within the written description as the interior bridge portion 54, and is shown in the Figures as a first interior bridge portion 54A, and a second interior bridge portion 54B. The sole plate 26 includes a lateral bridge portion 56 that is disposed between the lateral edge 46 of the sole plate 26 and the slot 52. If the sole plate 26 is configured with multiple slots 52, then the lateral bridge portion 56 is disposed between the lateral edge 46 of the sole plate 26 and a lateral most one of the at least two slots 52. The sole plate 26 further includes a medial bridge portion 58 that is disposed between the medial edge 48 of the sole plate 26 and the slot 52. If the sole plate 26 is configured with multiple slots 52, then the medial bridge portion 58 is disposed between the medial edge 48 of the sole plate 26 and the medial most one of the at least two slots 52. If the sole plate 26 is configured with multiple slots 52, which define one or more interior bridge portion 54, then the interior bridge portions 54 are disposed between the lateral bridge portion 56 and the medial bridge portion 58. The lateral bridge portion 56 may be referred to as a first bridge portion. The medial bridge portion 58 may be referred to as a third bridge portion. As shown in FIGS. 3 and 4, a first terminal end 51 of the stiffness controlling device 50 is disposed on the first bridge portion (lateral bridge portion 56) and a second terminal end 53 of the stiffness controlling device 50 is disposed on the third bridge portion (medial bridge portion 58).

Referring to FIGS. 2-5, the lateral bridge portion 56, the medial bridge portion 58, and the interior bridge portions 54 (if so configured) extend longitudinally along the longitudinal axis 44 of the sole plate 26, in the forefoot region of the sole plate 26. Generally, the overall longitudinal location of the lateral bridge portion 56, the medial bridge portion 58, and the interior bridge portions 54 along the longitudinal axis 44 of the sole plate 26 are selected so that an approximate midsection of the bridge portions 54, 56, 58 is positioned under the wearer's metatarsal phalangeal joints, and are positioned and sized to accommodate a range of positions of the wearer's metatarsal phalangeal joints based on population averages for the particular size of footwear 20.

Generally, the at least one interior bridge portion 54, the lateral bridge portion 56, and the medial bridge portion 58 extend between and connect the forefoot portion 38 and the midfoot portion 40 of the sole plate 26. Each slot 52A, 52B, 52C has a length 60 which is a first distance D along the longitudinal axis between a first axial end 66 and a second axial end 66 of the slot. The length 60 of the slot 52(*s*), as well as the length 60 of the interior bridge portions 54, the lateral bridge portion 56, and the medial bridge portion 58, measured along the longitudinal axis 44 of the sole plate 26, may vary depending upon a size of the foot to which the sole plate 26 is to be fitted, and the range or amount of adjustment desired in the bending stiffness of the soleplate 26. In some embodiments, the lengths 60 of the slots 52, and the lengths 60 of the bridge portions along the longitudinal axis 44 may be between 40 mm and 80 mm. The slots 52 may further include a width 62 measured transverse to the longitudinal axis 44 of the sole plate 26, along a line extending perpendicular to the longitudinal axis 44 and between the lateral edge 46 and the medial edge 48 of the sole plate 26. The width 62 of the slots 52 may vary. For example, the width 62 of the slots 52 may be between 3 mm and 10 mm.

In the exemplary embodiment shown in the Figures, the at least one slot 52 include three slots 52, i.e., a first slot 52A, a second slot 52B, and a third slot 52C. The three slots 52 are referred to generally by the reference numeral 52. The three slots 52 define two interior bridge portions 54 therebetween, i.e., a first interior bridge portion 54A and a second interior bridge portion 54B. The first and second interior bridge portions 54A, 54B are referred to generally by the reference numeral 54. As noted above, the stiffness controlling device 50 extends transverse relative to the longitudinal axis 44, and is interlaced between the lateral bridge portion 56, the first interior bridge portion 54A, the second interior bridge portion 54B, and the medial bridge portion 58. As used herein, the term "interlaced" is defined as to cross one another, typically passing alternately over and under, as if woven or intertwined together. Accordingly, as shown in the exemplary embodiment, the stiffness controlling device 50 is disposed or passes over the foot-receiving surface 34 of the lateral bridge portion 56, passes under the ground-facing surface 36 of the first interior bridge portion 54A, passes over the foot-receiving surface 34 of the second interior bridge portion 54B, and passes under the ground-facing surface 36 of the medial bridge portion 58. It should be appreciated that the stiffness controlling device 50 may be interlaced with the medial bridge portion 58, the lateral bridge portion 56, and the interior bridge portions 54, 56, 58 in some other manner not shown or described herein.

In some embodiments, the stiffness controlling device 50 is a substantially semi-rigid material. The substantially semi-rigid material may include any material having a durometer of 50D or greater. For example, the stiffness controlling device 50 may be a metal, such as stainless steel or aluminum, or may alternatively include a plastic, such as a nylon material or a thermoplastic polyurethane, although the embodiments are not limited only to those examples listed here, but can also include other similarly and suitably semi-rigid or rigid materials.

The stiffness controlling device 50 includes a width 64 measured along the longitudinal axis 44. In some embodiments, the width 64 of the stiffness controlling device 50 is between 3 mm and 15 mm. As shown in FIG. 3, the width 64 of the stiffness controlling device 50 along the longitudinal axis 44 is less than half of the first distance D. The stiffness controlling device 50 may include a generally planar shape. However, in other embodiments, the stiffness controlling device 50 may include an endless loop.

The stiffness controlling device 50 is moveable relative to the sole plate 26 and along the longitudinal axis 44, within the at least one slot 52. More specifically, the stiffness controlling device 50 is moveable or re-positionable along the longitudinal axis 44 relative to the bridge portions of the sole plate 26. The stiffness controlling device 50 is moveable between at least a first position, shown in FIGS. 2 and 3, and a second position, shown in FIGS. 4 and 5. When the stiffness controlling device 50 is disposed in the first position, the stiffness controlling device 50 is positioned adjacent an axial end 66 of the at least one slot 52 relative to the longitudinal axis 44 to provide a first bending stiffness of the sole plate 26, at a specific flex angle, against flex along the longitudinal axis 44. When the stiffness controlling device 50 is disposed in the second position, the stiffness controlling device 50 is positioned at an approximate midsection of the at least two slots 52 relative to the longitudinal axis 44 to provide a second bending stiffness of the sole plate 26, at the specific flex angle, against flex along the longitudinal axis 44. The first bending stiffness is less than the second bending stiffness. Both the first terminal end 51 and the second terminal end 53 of the stiffness controlling device 50 are further forward in the second position (FIG. 4) than in the first position (FIG.3). While the exemplary embodiment and the figures describe and show the stiffness controlling device 50 as being moveable between the first position and the second position, to provide the first bending stiffness and the second bending stiffness respectively, it should be appreciated that the stiffness controlling device 50 may be positionable at any number of positions between the first position and the second position, with each position providing a slightly different bending stiffness profile for the sole plate 26.

The bridge portions 54, 56, 58 may each be shaped to include either a concave or a convex shape along the longitudinal axis 44 in order to facilitate the positioning of the stiffness controlling device 50 along the longitudinal axis 44. For example, at least one of the interior bridge portions 54, the lateral bridge portion 56, and the medial bridge portion 58 may include a concave shape along the longitudinal axis 44 and relative to the foot receiving surface of the sole plate 26, and at least one of the interior bridge portions 54, the lateral bridge portion 56, and the medial bridge portion 58 may include a convex shape along the longitudinal axis 44 and relative to the foot receiving surface of the sole plate 26. Additionally, in the exemplary embodiment shown in the Figures and described herein, one of the first interior bridge portion 54A and the second interior bridge portion 54B may include a concave shape along the longitudinal axis 44 and relative to the foot receiving surface of the sole plate 26, and the other of the first interior bridge portion 54A and the second interior bridge portion 54B includes a convex shape along the longitudinal axis 44 and relative to the foot receiving surface of the sole plate 26. Furthermore, one of the lateral bridge portion 56 and the medial bridge portion 58 includes a concave shape along the longitudinal axis 44 and relative to the foot receiving surface of the sole plate 26, and the other of the lateral bridge portion 56 and the medial bridge portion 58 includes a convex shape along the longitudinal axis 44 and relative to the foot receiving surface of the sole plate 26. As shown in the exemplary embodiment of the Figures, with reference to FIGS. 2 and 4, the lateral bridge portion 56 and the first interior bridge portion 54A each include a convex shape along the longitudinal axis 44 and relative to the foot-receiving surface 34 of the sole plate 26, and the second interior bridge portion 54B and the medial bridge portion 58 each include a concave along the longitudinal axis 44 and relative to the foot-receiving surface 34 of the sole plate 26.

Figure 6:
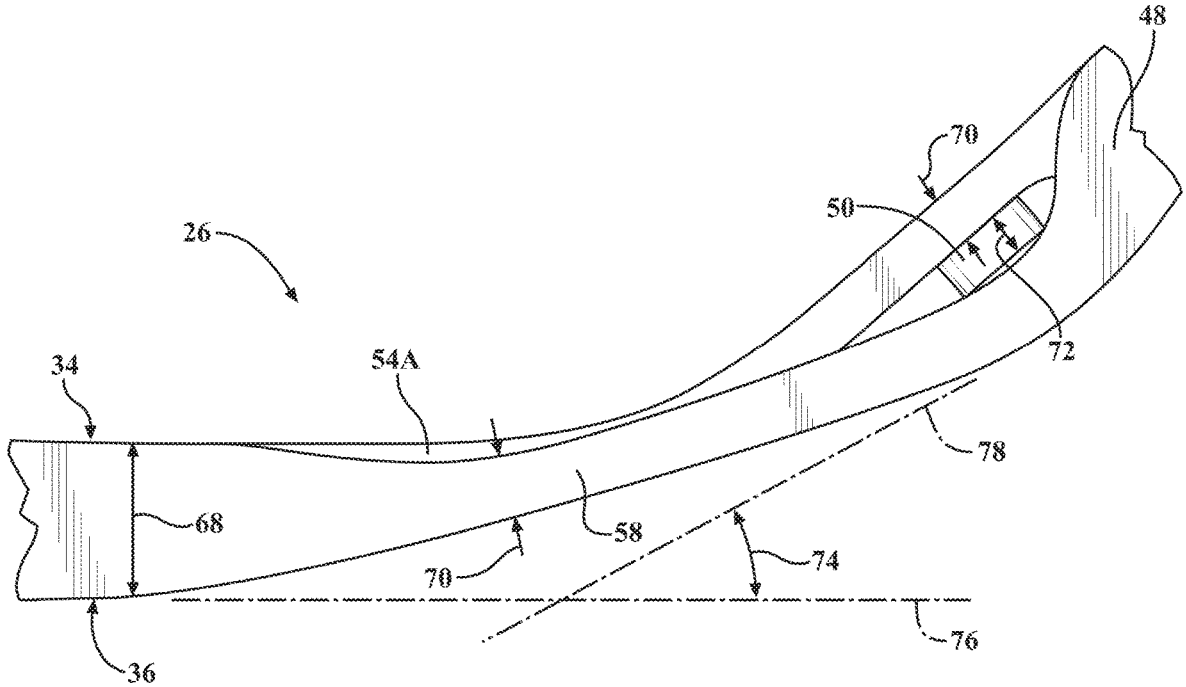
FIG. 6 is a schematic side view of the sole plate in flexion with the stiffness controlling device in the first position.
Figure 7:
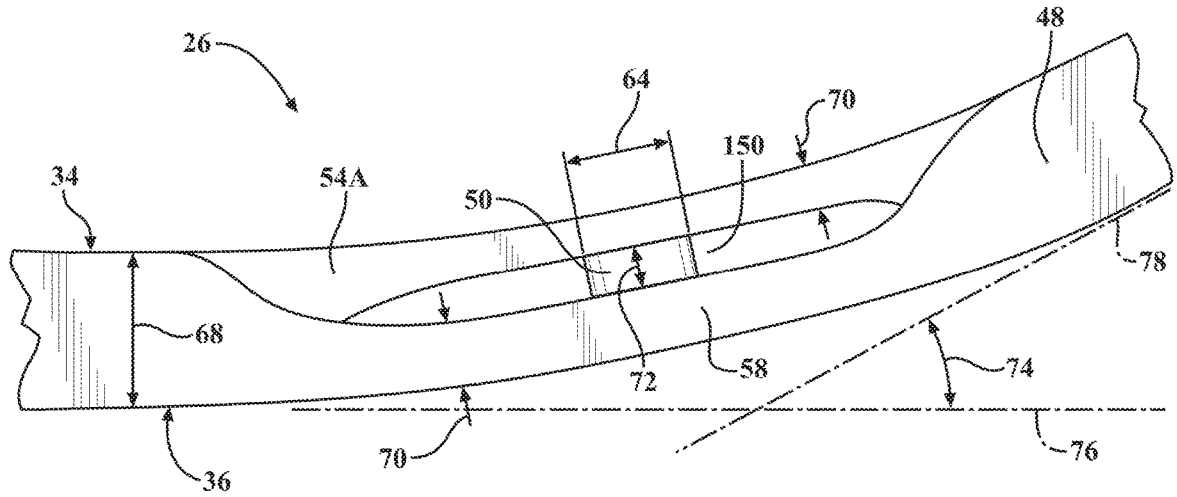
FIG. 7 is a schematic side view of the sole plate in flexion with the stiffness controlling device in the second position.

Referring to FIGS. 6 and 7, the sole plate 26 includes a sole thickness 68 that is measured between the foot-receiving surface 34 and the ground-facing surface 36. The sole thickness 68 may be between, for example, 3 mm and 10 mm. The concave shape and the convex shape of each of the at least one interior bridge portion 54, the medial bridge portion 58, and the lateral bridge portion 56 may include a minimum bridge thickness 70 at a midsection thereof, that is measured between the foot-receiving surface 34 and the ground-facing surface 36 of the respective bridge portions. The minimum bridge thickness 70 may be less than the sole thickness 68. For example, the minimum bridge thickness 70 may be between 1 mm and 3 mm.

In one exemplary embodiment, the minimum bridge thickness 70 may be less than one half the sole thickness 68. For example, the minimum bridge thickness 70 may be equal to one half the sole thickness 68 minus one half a thickness 72 of the stiffness controlling device 50. The thickness 72 of the stiffness controlling device 50 may be between, for example, 1 mm and 3 mm. In other embodiments, the minimum bridge thickness 70 may be greater than one half the sole thickness 68. For example, the minimum bridge thickness 70 may be equal to the sole thickness 68 minus the thickness 72 of the stiffness controlling device 50.

In other embodiments, the bridge portions of the sole structure 24 may be formed to include notches (not shown) for receiving the stiffness controlling device 50 in predefined locations, such as the first position and the second position. Such notches may be sized and shaped to mate with the stiffness controlling device 50, such that the stiffness controlling device 50 is securely fitted within the notch and held in place relative to the slots 52, so that the stiffness controlling device 50 does not become dislodged and/or move unintentionally from a desired position, along the longitudinal axis 44 and relative to the bridge portion.

As noted above, the position of the stiffness controlling device 50 within the slots 52 and relative to the bridge portions of the sole plate 26 determines the bending stiffness at a specific flex angle of the sole plate 26. Changing the position of the stiffness controlling device 50 within the slots 52 and relative to the bridge portions changes the bending stiffness at that specific flex angle of the sole plate 26. The bending stiffness of the sole plate 26 provides the resistance against dorsiflexion of the sole plate 26 in the longitudinal direction along the longitudinal axis 44 of the sole plate 26.

Referring to FIGS. 6 and 7, the flex angle 74 is defined as the angle formed at the intersection between a first axis 76 and a second axis 78. The first axis 76 generally extends along the longitudinal axis 44 of the sole plate 26 at the ground-facing surface 36 of the sole plate 26 forward or anterior to the slots 52. The longitudinal axis 44 of the sole plate 26 may also be referred to as a longitudinal midline of the sole plate 26. The second axis 78 generally extends along the longitudinal axis 44 of the sole plate 26 at the ground-facing surface 36 of the sole plate 26 rearward or posterior to the slots 52. The sole plate 26 is configured so that the intersection of the first axis 76 and the second axis 78 is approximately centered both longitudinally and transversely below the metatarsal-phalangeal joints of a foot supported on the foot-receiving surface 34 of the sole plate 26. Changing or re-positioning the stiffness controlling device 50 within the slots 52 and relative to the bridge portions of the sole plate 26 changes the bending stiffness that the sole plate 26 exhibits at similar flex angles 74. In other words, the sole plate 26 may exhibit a first bending stiffness at a specific flex angle 74 with the stiffness controlling device 50 in the first position, and exhibit a second bending stiffness at the same specific flex angle 74 with the stiffness controlling device 50 in the second position.

Figure 8:
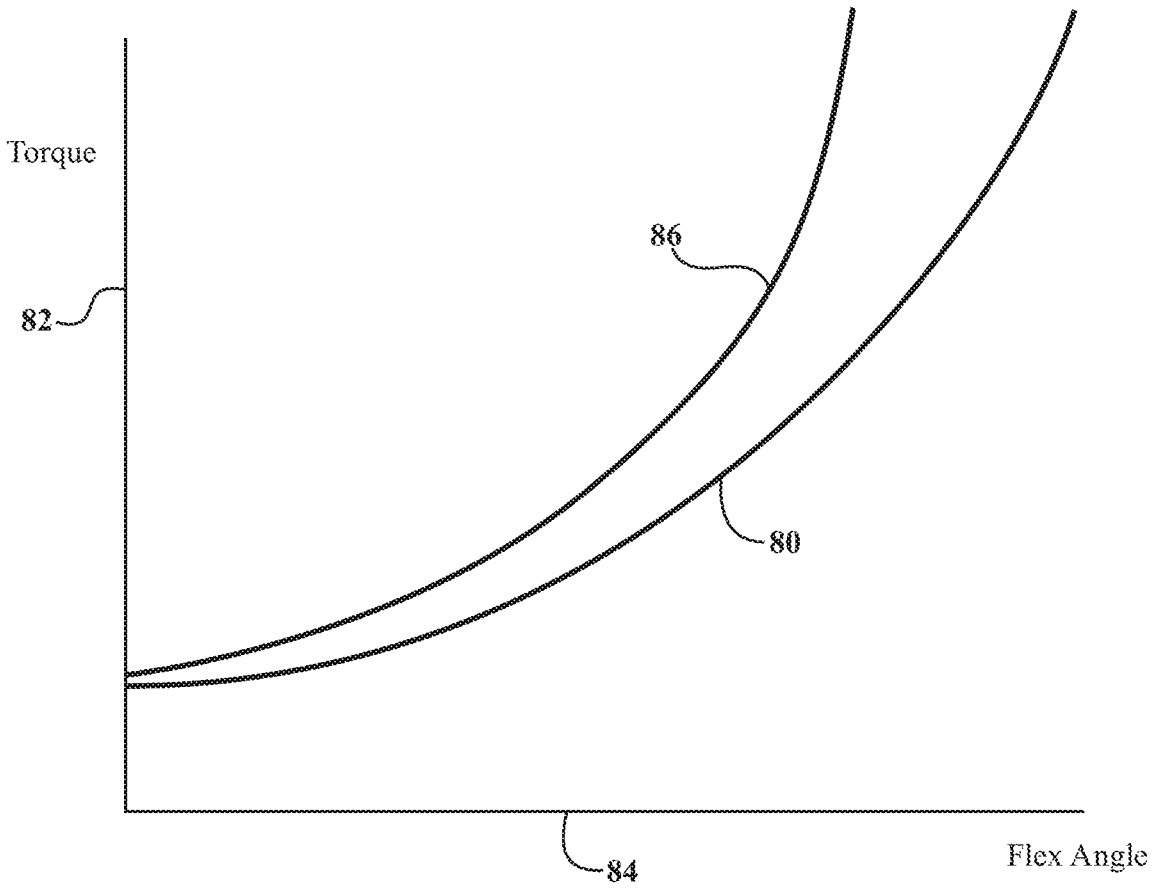
FIG. 8 is a plot of torque versus flexion angle for the sole plate showing a bending stiffness of the sole plate with the stiffness controlling device in the first position, and a bending stiffness of the sole plate with the stiffness controlling device in the second position.

As a wearer's foot flexes by lifting the heel portion 42 away from a ground surface, while maintaining contact with the ground surface at the forefoot portion 38, it places torque on the sole structure 24 and causes the sole plate 26 to flex through the forefoot portion 38. Referring to FIG. 8, an example plot indicating the bending stiffness (slope of the line) of the sole plate 26 with the stiffness controlling device 50 in the first position is generally shown at 80. Torque (in Newton-meters) is shown on a vertical axis 82, and the flex angle 74 (in degrees) is shown on a horizontal axis 84. As is understood by those skilled in the art, the torque results from a force applied at a distance from a bending axis located in the proximity of the metatarsal phalangeal joints, as occurs when a wearer flexes the sole structure 24. The bending stiffness of the sole plate 26 may be constant (thus the plot would have a linear slope) or substantially linear, or may increase gradually (which would show a change in slope with changes in flex angle). As shown in the exemplary plot of FIG. 8, the bending stiffness changes (increases) as the flex angle 74 changes (increases). Additionally, the rate at which the bending stiffness increases as the torque increases also changes, with the rate at which the bending stiffness increases increasing as the flex angle 74 and torque of the sole plate 26 increases. Accordingly, the bending stiffness of the sole plate 26 may be considered non-linear.

Those skilled in the art will appreciate that portions of the sole plate 26 (such as portions of the sole plate 26 near the foot receiving surface) may be placed in compression during flexion of the sole plate 26, while other portions of the sole plate 26, (such as portion of the sole plate 26 near the ground-facing surface 36) may be placed in tension during flexion of the sole plate 26. The greater the distance from the bending axis that the compressive and tensile forces of the sole plate 26 are applied, the greater the bending stiffness of the sole plate 26. Accordingly, increasing the relative distance between the bending axis and the compressive forces and/or the tensile forces increases the bending stiffness of the sole plate 26, whereas decreasing the relative distance between the bending axis and the compressive forces and/or the tensile forces decreases the bending stiffness of the sole plate 26.

With the stiffness controlling device 50 in the first position, such as shown in FIGS. 2, 3 and 6, the midsection of the bridge portions 54, 56, 58 are free to flex or bend relative to each other. In the exemplary embedment shown, this allows the midsection of the lateral bridge portion 56 and the second interior bridge portion 54B to raise up toward the foot-receiving surface 34, and the midsection of the first interior bridge portion 54A and the medial bridge portion 58 to fall downward toward the ground-facing surface 36. Allowing the bridge portions 54, 56, 58 to move closer to the bending axis, i.e., allowing the bridge portions 54, 56, 58 to decrease their relative distance between the bending axis and the compressive forces and the tensile forces, decreases their bending stiffness, thereby reducing the bending stiffness of the sole plate 26. Furthermore, allowing the bridge portions 54, 56, 58 to move toward each other, i.e., allowing the midsection of the lateral bridge portion 56 and the second interior bridge portion 54B to raise up toward the foot-receiving surface 34, and the midsection of the first interior bridge portion 54A and the medial bridge portion 58 to fall downward toward the ground-facing surface 36, aligns the bridge portions 54, 56, 58 so that they behave as a single, thin piece of material, having an approximate thickness equal to the minimum bridge thickness 70, instead of the sole thickness 68.

With the stiffness controlling device 50 in the second position, such as shown in FIGS. 4, 5 and 7, the midsection of the bridge portions 54, 56, 58 are not free to flex or bend relative to each other, because the stiffness controlling device 50 is positioned at the midsection of the bridge portions 54, 56, 58, and maintains the relative separation between the bridge portions 54, 56, 58. In the exemplary embedment shown, this prevents the midsection of the lateral bridge portion 56 and the second interior bridge portion 54B from raising up toward the foot-receiving surface 34, and the midsection of the first interior bridge portion 54A and the medial bridge portion 58 from falling downward toward the ground-facing surface 36. Preventing the bridge portions 54, 56, 58 from moving closer to the bending axis, i.e., preventing the bridge portions 54, 56, 58 from decreasing their relative distance between the bending axis and the compressive forces and the tensile forces, increases their bending stiffness, thereby reducing the bending stiffness of the sole plate 26. Furthermore, preventing the bridge portions 54, 56, 58 from moving toward each other, i.e., preventing the midsection of the lateral bridge portion 56 and the second interior bridge portion 54B from raising up toward the foot-receiving surface 34, and the midsection of the first interior bridge portion 54A and the medial bridge portion 58 from falling downward toward the ground-facing surface 36, maintains the vertical separation between the bridge portions 54, 56, 58 maintains a high moment of inertia in the sole plate 26, maintaining the bending stiffness of the sole plate 26.

Referring to FIG. 8, an example plot indicating the bending stiffness (slope of the line) of the sole plate 26 with the stiffness controlling device 50 in the second position is generally shown at 86. Torque (in Newton-meters) is shown on the vertical axis 82, and the flex angle 74 (in degrees) is shown on the horizontal axis 84. With the stiffness controlling device 50 in the second position, such as shown in FIGS. 4, 5 and 7, the midsection of the bridge portions are not free to flex or move closer to the bending axis. In other words, the stiffness controlling device 50 resists or limits movement of the midsection of the lateral bridge portion 56 and the second interior bridge portion 54B toward the foot-receiving surface 34, and limits the midsection of the first interior bridge portion 54A and the medial bridge portion 58 toward the ground-facing surface 36, altering or changing the bending stiffness of the sole plate 26 at any specific flex angle when compared to the bending stiffness profile of the sole plate 26 with the stiffness controlling device 50 in the first position at a similar flex angle. Accordingly, as shown in FIG. 8, the bending stiffness shown by line 80, with the stiffness controlling device 50 in the first position, is less than the bending stiffness shown by line 86, with the stiffness controlling device 50 in the second position.

The different longitudinal positions that the stiffness controlling device 50 may be disposed in within the slots 52 and relative to the bridge portions of the sole plate 26 allow the wearer to customize the bending stiffness of the sole plate 26 to their particular needs and/or preferences, thereby providing greater comfort and support to the wearer. The position of the stiffness controlling device 50 within the slots 52 is selectable and changeable by the user to provide an on/off change in stiffness at any given flex angle throughout a range of flex angles of the sole plate 26. For example, the "off" position may include the stiffness controlling device 50 positioned in the first position, and the "on" position may include the stiffness controlling device 50 positioned in the second position. The user may wish to position the stiffness controlling device 50 in the off or first position when not playing or otherwise engaged in an active athletic activity, and may position the stiffness controlling device 50 in the on or second position when playing or engaged in an active athletic activity.

The sole structure 24 may include other layers above and/or below the sole plate 26. For example, the sole structure 24 may include a custom sock liner or other layer that has portions and/or is shaped to fill the unevenness between the bridge portions 54, 56, 58 and the stiffness controlling device 50 from above the foot-receiving surface 34.

Figure 9:
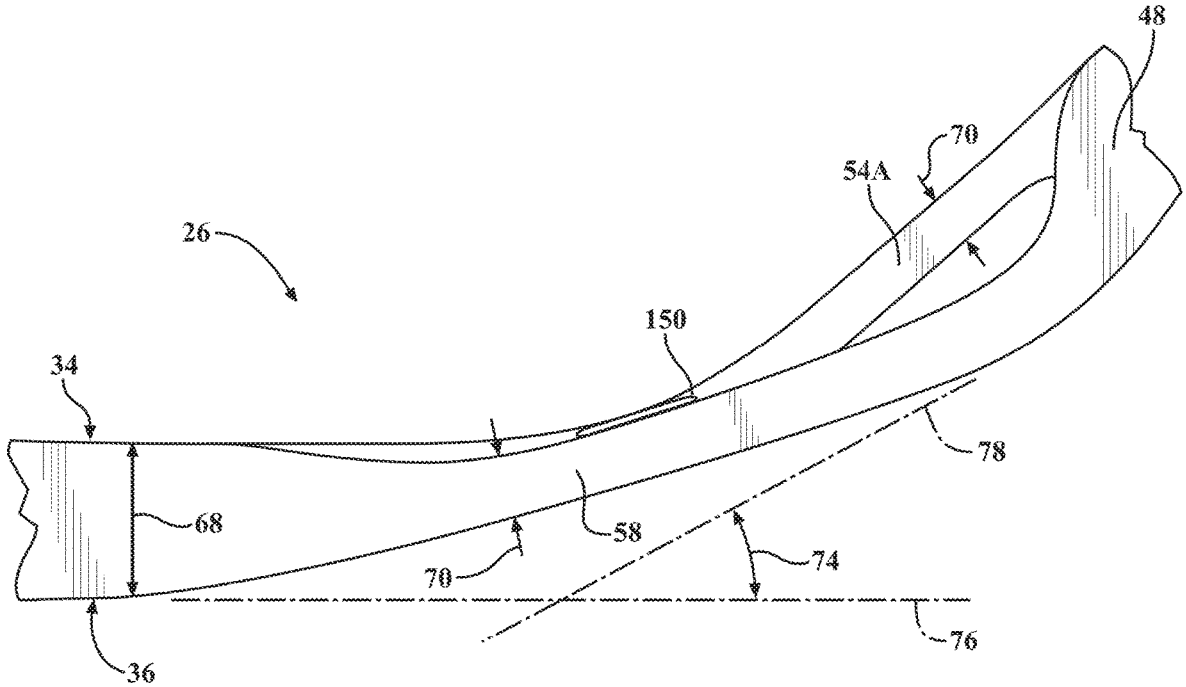
FIG. 9 is a schematic side view of the sole plate in flexion with an alternative embodiment of the stiffness controlling device in a non-inflated condition.
Figure 10:
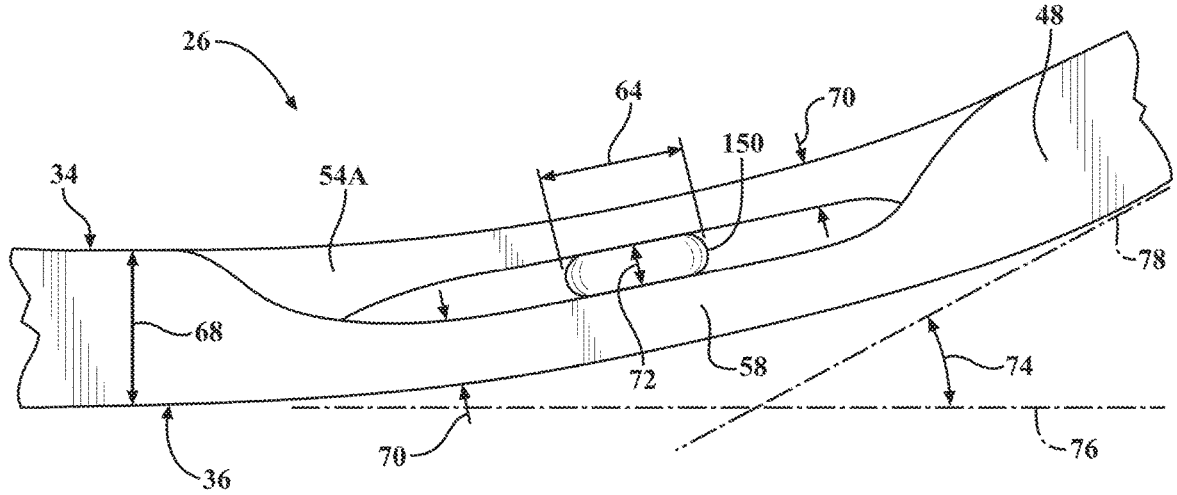
FIG. 10 is a schematic side view of the sole plate in flexion with the alternative embodiment of the stiffness controlling device in an inflated condition.

Referring to FIGS. 9, and 10, an alternative embodiment of the stiffness controlling device is generally shown 150. As shown in FIGS. 9, and 10, the stiffness controlling device 150 includes an inflatable device, such as but not limited to a balloon, bubble, or some other closed space bounded by a flexible wall membrane. The stiffness controlling device 150 is moveable relative to the sole plate between a non-inflated condition, shown in FIG. 9, and an inflated condition shown in FIG. 10. When the stiffness controlling device 150 is positioned in the non-inflated condition, the stiffness controlling device 150 allows the midsection of the bridge portions 54, 56, 58 to flex or bend relative to each other to provide the first bending stiffness of the sole plate at the flex angle against flex along the longitudinal axis. When the stiffness controlling device 150 is positioned in the inflated condition, the stiffness controlling device 150 prevents the midsections of the bridge portions 54, 56, 58 to flex or bend relative to each other to provide the second bending stiffness of the sole plate at the flex angle against flex along the longitudinal axis.

The non-inflated condition shown in FIG. 9 allows the midsection of the lateral bridge portion 56 and the second interior bridge portion 54B to raise up toward the foot-receiving surface 34, and the midsection of the first interior bridge portion 54A and the medial bridge portion 58 to fall downward toward the ground-facing surface 36. Allowing the bridge portions 54, 56, 58 to move closer to the bending axis, i.e., allowing the bridge portions 54, 56, 58 to decrease their relative distance between the bending axis and the compressive forces and the tensile forces, decreases their bending stiffness, thereby reducing the bending stiffness of the sole plate 26. Furthermore, allowing the bridge portions 54, 56, 58 to move toward each other, i.e., allowing the midsection of the lateral bridge portion 56 and the second interior bridge portion 54B to raise up toward the foot-receiving surface 34, and the midsection of the first interior bridge portion 54A and the medial bridge portion 58 to fall downward toward the ground-facing surface 36, aligns the bridge portions 54, 56, 58 so that they behave as a single, thin piece of material, having an approximate thickness equal to the minimum bridge thickness 70, instead of the sole thickness 68.

The inflated position shown in FIG. 10 prevents the midsection of the lateral bridge portion 56 and the second interior bridge portion 54B from raising up toward the foot-receiving surface 34, and the midsection of the first interior bridge portion 54A and the medial bridge portion 58 from falling downward toward the ground-facing surface 36. Preventing the bridge portions 54, 56, 58 from moving closer to the bending axis, i.e., preventing the bridge portions 54, 56, 58 from decreasing their relative distance between the bending axis and the compressive forces and the tensile forces, increases their bending stiffness, thereby reducing the bending stiffness of the sole plate 26. Furthermore, preventing the bridge portions 54, 56, 58 from moving toward each other, i.e., preventing the midsection of the lateral bridge portion 56 and the second interior bridge portion 54B from raising up toward the foot-receiving surface 34, and the midsection of the first interior bridge portion 54A and the medial bridge portion 58 from falling downward toward the ground-facing surface 36, maintains the vertical separation between the bridge portions 54, 56, 58 maintains a high moment of inertia in the sole plate 26, maintaining the bending stiffness of the sole plate 26.

The stiffness controlling device 150, shown in FIGS. 9 and 10 may include and be manufactured from any flexible, yet durable material capable of being repeatedly inflated and deflated, and providing the requisite rigidity when inflated to maintain separation of the bridge portions 54, 56, 58. It should be appreciated, that unlike the stiffness controlling device 50 shown in FIGS. 1-7, the stiffness controlling device 150, shown in FIGS. 9 and 10, does not move along the longitudinal axis and within the slots 52 relative to the sole plate 26. Rather, the stiffness controlling device 150 inflates, i.e., moves outward away and/or toward the ground-facing surface and/or the foot-receiving surface of the sole plate 26.

The detailed description and the Figures are supportive and descriptive of the present teachings, but the scope of the present teachings is defined solely by the appended claims. While several modes for carrying out the many aspects of the present teachings have been described in detail, those familiar with the art to which these teachings relate will recognize various alternative aspects for practicing the present teachings that are within the scope of the appended claims.

The invention claimed is:

1. A sole structure for an article of footwear, the sole structure comprising:

a sole plate extending along a longitudinal axis and including a lateral side and a medial side, and including a forefoot portion, a heel portion, and a midfoot portion disposed between the forefoot portion and the heel portion;

wherein the sole plate includes at least two slots disposed in the forefoot portion of the sole plate and extending along the longitudinal axis and defining a lateral bridge portion disposed between the lateral side of the sole plate and a lateral most one of the at least two slots in the forefoot portion of the sole plate, a medial bridge portion disposed between the medial side of the sole plate and a medial most one of the at least two slots in the forefoot portion of the sole plate, and at least one interior bridge portion disposed between the at least two slots in the forefoot portion of the sole plate;

a stiffness controlling device extending transversely relative to the longitudinal axis and interlaced with the lateral bridge portion, the at least one interior bridge portion, and the medial bridge portion; and wherein the at least two slots have a first axial end and a second axial end spaced apart from the first axial end by a first distance along the longitudinal axis, and the stiffness controlling device has a width along the longitudinal axis that is less than half of the first distance.

2. The sole structure set forth in claim 1, wherein the stiffness controlling device is moveable relative to the sole plate, and provides a first bending stiffness of the sole plate when disposed in a first location along the longitudinal axis, and provides a second bending stiffness of the sole plate when disposed in a second location along the longitudinal axis.

3. The sole structure set forth in claim 2, wherein the stiffness controlling device provides the first bending stiffness against dorsiflexion of the forefoot portion of the sole plate when positioned at the first location along the longitudinal axis of the sole plate, and provides the second bending stiffness against dorsiflexion of the forefoot portion of the sole plate when positioned at the second location along the longitudinal axis of the sole plate.

4. The sole structure set forth in claim 2, wherein the stiffness controlling device is moveable along the longitudinal axis, within the at least two slots.

5. The sole structure set forth in claim 4, wherein the stiffness controlling device is moveable fore and aft along the longitudinal axis and is disposed at the first axial end of the at least two slots in the first location and is disposed at a midsection of the at least two slots in the second location, with the first bending stiffness being lower than the second bending stiffness.

6. The sole structure set forth in claim 1, wherein the at least two slots are spaced apart from each other and extend along the longitudinal axis to define the at least one interior bridge portion disposed between the at least two slots.

7. The sole structure set forth in claim 6, wherein the stiffness controlling device is interlaced with the lateral bridge portion, the at least one interior bridge portion, and the medial bridge portion.

8. The sole structure set forth in claim 1, wherein the sole plate presents a foot-receiving surface and a ground-facing surface disposed opposite the foot-receiving surface.

9. The sole structure set forth in claim 8, wherein at least one of the at least one interior bridge portion, the lateral bridge portion, and the medial bridge portion includes a concave shape along the longitudinal axis and relative to the foot-receiving surface of the sole plate, and at least another of the at least one interior bridge portion, the lateral bridge portion, and the medial bridge portion includes a convex shape along the longitudinal axis and relative to the foot-receiving surface of the sole plate.

10. The sole structure set forth in claim 8, wherein one of the midfoot portion and the heel portion of the sole plate includes a sole thickness between the foot-receiving surface and the ground-facing surface, and wherein each of the at least one interior bridge portion, the medial bridge portion, and the lateral bridge portion includes a minimum bridge thickness at a midsection thereof that is less than the sole thickness.

11. The sole structure set forth in claim 10, wherein the minimum bridge thickness is less than one half the sole thickness.

12. The sole structure set forth in claim 1, wherein the at least two slots are spaced apart from each other and extend along the longitudinal axis to define the at least one interior bridge portion disposed between the at least two slots; and wherein the at least two slots include three slots, and the at least one interior bridge portion includes a first interior bridge portion and a second interior bridge portion.

13. The sole structure set forth in claim 12, wherein one of the first interior bridge portion and the second interior bridge portion includes a concave shape along the longitudinal axis and relative to a foot receiving surface of the sole plate, and the other of the first interior bridge portion and the second interior bridge portion includes a convex shape along the longitudinal axis and relative to the foot receiving surface of the sole plate.

14. The sole structure set forth in claim 12, wherein one of the lateral bridge portion and the medial bridge portion includes a concave shape along the longitudinal axis and relative to a foot receiving surface of the sole plate, and the other of the lateral bridge portion and the medial bridge portion includes a convex shape along the longitudinal axis and relative to the foot receiving surface of the sole plate.

15. The sole structure set forth in claim 1, wherein the at least one interior bridge portion, the lateral bridge portion, and the medial bridge portion extend between and connect the forefoot portion and the midfoot portion of the sole plate.

16. The sole structure set forth in claim 1, wherein the stiffness controlling device is a semi-rigid material.

17. The sole structure set forth in claim 16, wherein the stiffness controlling device comprises one of either a metal or a polymer.

18. The sole structure set forth in claim 1, wherein the stiffness controlling device includes a width measured along the longitudinal axis of the sole plate that is between 3 mm and 15 mm.

19. The sole structure set forth in claim 1, wherein the stiffness controlling device is moveable between a non-inflated position providing a first bending stiffness against dorsiflexion of the sole plate along the longitudinal axis, and an inflated position providing a second bending stiffness against dorsiflexion of the sole plate along the longitudinal axis, with the first bending stiffness being lower than the second bending stiffness.

20. A sole structure for an article of footwear, the sole structure comprising:

a sole plate including a forefoot portion, a heel portion, and a midfoot portion disposed between the forefoot portion and the heel portion, and including at least a first bridge portion, a second bridge portion, and a third bridge portion, each extending along a longitudinal axis, and each disposed within the forefoot portion of the sole plate; wherein the second bridge portion is disposed between the first bridge portion and the third bridge portion;

a stiffness controlling device extending transversely relative to the longitudinal axis and woven between the first bridge portion, the second bridge portion, and the third bridge portion; wherein the stiffness controlling device includes a first terminal end disposed on the first bridge portion and a second terminal end disposed on the third bridge portion;

wherein the stiffness controlling device is moveable fore and aft along the longitudinal axis of the sole plate between at least a first position disposed at an axial end of first bridge portion, the second bridge portion, and the third bridge portion, relative to the longitudinal axis, to provide a first bending stiffness against dorsiflexion of the forefoot portion of the sole plate along the longitudinal axis, and a second position disposed at a midsection of the first bridge portion, the second bridge portion, and the third bridge portion, relative to the longitudinal axis, to provide a second bending stiffness against dorsiflexion of the forefoot portion of the sole plate along the longitudinal axis, with the first bending stiffness being lower than the second bending stiffness; and wherein both the first terminal end and the second terminal end of the stiffness controlling device are further forward in the second position than in the first position.

21. The sole structure set forth in claims 20, wherein the sole plate presents a foot-receiving surface and a ground-facing surface disposed opposite the foot-receiving surface.

22. The sole structure set forth in claim 21, wherein one of the first bridge portion, the second bridge portion, and the third bridge portion includes a concave shape along the longitudinal axis and relative to the foot-receiving surface of the sole plate, and another of the first bridge portion, the second bridge portion, and the third bridge portion includes a convex shape along the longitudinal axis and relative to the foot-receiving surface of the sole plate.

23. The sole structure set forth in claim 22, wherein one of the midfoot portion and the heel portion of the sole plate includes a sole thickness between the foot-receiving surface and the ground-facing surface, and wherein each of the first bridge portion, the second bridge portion, and the third bridge portion includes a minimum bridge thickness at a midsection thereof that is less than the sole thickness.

24. The sole structure set forth in claim 20, wherein the stiffness controlling device is a semi-rigid material.

* * * * *